US011761389B2

(12) United States Patent
Kim et al.

(10) Patent No.: US 11,761,389 B2
(45) Date of Patent: Sep. 19, 2023

(54) APPARATUS AND METHOD FOR CHARGING LPG FUEL OF BI-FUEL VEHICLE

(71) Applicants: Hyundai Motor Company, Seoul (KR); Kia Corporation, Seoul (KR)

(72) Inventors: Chang Han Kim, Gwangju (KR); Sung Hwan Ji, Seoul (KR); Seung Hoon Choi, Seoul (KR); Jun Sik Lim, Incheon (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 47 days.

(21) Appl. No.: 17/699,472

(22) Filed: Mar. 21, 2022

(65) Prior Publication Data

US 2022/0298980 A1 Sep. 22, 2022

(30) Foreign Application Priority Data

Mar. 22, 2021 (KR) ..... 10-2021-0036440

(51) Int. Cl.
*F02D 19/06* (2006.01)
*F02D 19/08* (2006.01)

(52) U.S. Cl.
CPC ..... *F02D 19/0647* (2013.01); *F02D 19/0605* (2013.01); *F02D 19/0681* (2013.01); *F02D 19/08* (2013.01)

(58) Field of Classification Search
CPC .. F02D 19/08; F02D 19/0681; F02D 19/0605; F02D 19/0647
USPC ... 123/525, 527, 27 GE, 510, 511, 518, 519, 123/520
See application file for complete search history.

(56) References Cited

FOREIGN PATENT DOCUMENTS

| | | | | |
|---|---|---|---|---|
| AU | 2010246477 | * | 7/2011 | ..... F02D 19/06 |
| JP | 3098459 | * | 10/2003 | ..... F17C 7/02 |
| NL | 2001345 | * | 9/2009 | ..... F02D 19/06 |
| WO | WO 2010/076004 | * | 7/2010 | |
| WO | WO 2011/041705 | * | 4/2011 | ..... F02B 43/00 |

* cited by examiner

*Primary Examiner* — Hai H Huynh
(74) *Attorney, Agent, or Firm* — MORGAN, LEWIS & BOCKIUS LLP

(57) ABSTRACT

An apparatus of charging Liquefied Petroleum Gas (LPG) fuel of a bi-fuel vehicle includes: a gasoline mixing chamber mounted on an LPG bombe side, a gasoline fuel supply line connecting the gasoline mixing chamber with a fuel tank and allowing gasoline fuel to move to the gasoline mixing chamber as a first valve is open, an LPG fuel supply line connecting an LPG bombe with the gasoline mixing chamber and allowing LPG fuel to move to the gasoline mixing chamber as a second valve is open, and a control unit configured to open the first valve and control the LPG fuel to be recirculated to the LPG bombe together with the gasoline fuel by a pressure of the LPG fuel moving to the gasoline mixing chamber, as an internal pressure of the LPG bombe reaches a predetermined reference pressure.

20 Claims, 6 Drawing Sheets

APPARATUS AND METHOD FOR CHARGING LPG FUEL OF BI-FUEL VEHICLE

CROSS-REFERENCE TO RELATED APPLICATION

The present application claims priority to Korean Patent Application No. 10-2021-0036440 filed on Mar. 22, 2021, the entire contents of which is incorporated herein for all purposes by this reference.

BACKGROUND OF INVENTION

Field of the Present Disclosure

The present disclosure relates to an apparatus and a method for charging Liquefied Petroleum Gas (LPG) fuel for a bi-fuel vehicle, and more specifically, to an apparatus and a method for charging LPG fuel for a bi-fuel vehicle, which may separately install a gasoline mixing chamber in an LPG bombe and allow gasoline to move to the gasoline mixing chamber so that gasoline fuel and the LPG fuel are selectively recirculated to the LPG bombe together to cool the inside of the LPG bombe and decrease the vapor pressure of the LPG fuel, improving the rechargeability of the LPG.

Description of Related Art

Currently, a fuel supply system for returning a part of the LPG fuel supplied to an engine to an LPG bombe is applied to an LPG fuel vehicle.

In other words, because it is difficult to accurately control the fuel amount actually supplied to the engine due to a phenomenon in which a part of the LPG fuel supplied to the engine is vaporized by high temperature (vapor lock phenomenon), a system for supplying the LPG fuel supplied to the engine in a sufficient amount greater than the amount required for combustion and returning the remaining unburned fuel to the LPG bombe is applied in consideration of the above.

Describing a charging process of the present LPG fuel vehicle with reference to FIG. 1, the charging process includes driving a charging pump 2 of a charging station, transferring LPG fuel from an LPG storage 1 of the charging station to a charging gun 3 by driving the charging pump 2, and charging the LPG fuel in an LPG bombe of a vehicle by an LPG charging pressure of the charging gun 3.

At the present time, there is a problem in that when the internal temperature and pressure of the LPG bombe increase as the unburned fuel (a state where the temperature is increased by a high-temperature engine) is returned to the LPG bombe after being supplied to the engine, it is not possible to recharge the LPG fuel.

In other words, there is a problem in that when the internal temperature and pressure of the LPG bombe increase above a pressure for charging the LPG fuel in the LPG bombe by the high-temperature LPG fuel returned from the engine, it is not possible to recharge the LPG fuel from the charging gun to the LPG bombe.

Furthermore, there is a problem in that because the pressure in the LPG bombe is higher than the LPG charging pressure under the condition that the outside temperature rapidly increases due to the hot season, it is not possible to charge the LPG fuel more.

The information included in this Background of the present disclosure section is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing an apparatus and a method for charging an LPG fuel of a bi-fuel vehicle, which may install a gasoline mixing chamber in an LPG bombe, allow gasoline fuel to move to the gasoline mixing chamber as a pressure of the LPG bombe reaches a reference pressure of a charging station, and also allow LPG fuel to move to the gasoline mixing chamber so that the gasoline fuel and the LPG fuel are recirculated to an LPG bombe together to cool the inside of the LPG bombe and at the same time, decrease a vapor pressure of the LPG fuel, thereby improving the rechargeability of the LPG so that the LPG fuel may be charged even under the condition that the outside temperature rapidly increases due to the hot season.

An apparatus of charging LPG fuel of a bi-fuel vehicle according to various exemplary embodiments of the present disclosure may include a gasoline mixing chamber mounted on an LPG bombe side, a gasoline fuel supply line connecting the gasoline mixing chamber with a fuel tank and allowing gasoline fuel to move to the gasoline mixing chamber as a first valve is open, an LPG fuel supply line connecting an LPG bombe with the gasoline mixing chamber and allowing LPG fuel to move to the gasoline mixing chamber as a second valve is open, and a control unit configured to open the first valve and control the LPG fuel to be recirculated to the LPG bombe together with the gasoline fuel by a pressure of the LPG fuel moving to the gasoline mixing chamber, as an internal pressure of the LPG bombe reaches a predetermined reference pressure.

Here, when a preset supply time elapses depending upon a capacity of the gasoline mixing chamber, the control unit is configured to block the first valve and operates a line per inch (LPI) pump provided on the LPG bombe to supply the LPG fuel to open the second valve.

Furthermore, when a preset supply time elapses depending upon a capacity of the gasoline mixing chamber, the control unit shields the first valve, maintains a state where the second valve is shielded, and allows the LPG fuel to flow into the LPG bombe together with the gasoline fuel accommodated in the gasoline mixing chamber by use of a charging pressure of an LPG charger.

Furthermore, the gasoline mixing chamber is mounted on a quick coupling classified into a relatively low pressure in the LPG bombe by a check valve provided on the LPG bombe.

The gasoline mixing chamber includes: a gasoline supply portion connected to the gasoline fuel supply line, an LPG supply portion connected to the LPG fuel supply line, a body portion including the gasoline fuel and the LPG fuel introduced through the gasoline supply portion and the LPG supply portion, respectively accommodated therein, and a discharging portion connected to the LPG bombe so that the gasoline fuel and the LPG fuel move to the LPG bombe together due to an increase in the internal pressure as the LPG fuel is supplied to the body portion.

Meanwhile, a method for charging LPG fuel of a bi-fuel vehicle according to various exemplary embodiments of the present disclosure may include comparing, by a control unit, an internal pressure of an LPG bombe with a predetermined reference pressure, supplying gasoline fuel that opens a first valve to allow gasoline fuel to flow along a gasoline fuel supply line and to move to a gasoline mixing chamber by the control unit when the internal pressure of the LPG bombe exceeds the predetermined reference pressure in the comparing, supplying LPG fuel that allows the LPG fuel to move to the gasoline mixing chamber in a state where the gasoline fuel is accommodated in the gasoline mixing chamber, and recirculating the LPG fuel that allows the LPG fuel to be supplied to the LPG bombe together with the gasoline fuel accommodated in the gasoline mixing chamber by a pressure of the LPG fuel moving to the gasoline mixing chamber.

Here, when a preset supply time elapses depending upon a capacity of the gasoline mixing chamber, the supplying of the LPG fuel blocks the first valve and operates a line per inch (LPI) pump provided on the LPG bombe by the control unit to supply the LPG fuel to open the second valve.

The supplying of the LPG fuel includes: operating the LPI pump by blocking the first valve by the control unit and opening the second valve that allows the LPG fuel accommodated in the LPG bombe to have a pressure and to be supplied to the gasoline mixing chamber.

At the present time, the recirculating of the fuel includes: interrupting an operation of the LPI pump as a charging pressure of the LPG fuel is greater than the pressure of the LPG bombe.

Furthermore, the supplying of the LPG fuel includes: determining whether to enter a refueling mode that blocks the first valve and determines whether to enter a refueling mode in a state where the gasoline fuel is accommodated in the gasoline mixing chamber.

Here, the determining of whether to enter the refueling mode maintains the state where the second valve is blocked and allows the LPG fuel to be supplied to the LPG bombe together with the gasoline fuel accommodated in the gasoline mixing chamber by use of a charging pressure of an LPG charger when it is determined as entering the refueling mode.

Furthermore, the determining of whether to enter the refueling mode blocks the first valve and operates an LPI pump provided on the LPG bombe to open the second valve by the control unit to supply the LPG fuel when a preset supply time elapses depending upon a capacity of the gasoline mixing chamber when it is determined as not entering the refueling mode.

Meanwhile, the gasoline mixing chamber is mounted on a quick coupling classified into a relatively low pressure in the LPG bombe by a check valve provided on the LPG bombe.

According to an exemplary embodiment of the present disclosure, it is possible to install the gasoline mixing chamber in the quick coupling of the LPG bombe, allow the gasoline fuel to move to the gasoline mixing chamber as the pressure of the LPG bombe reaches the reference pressure of the charging station, and also allow the LPG fuel to move to the gasoline mixing chamber so that the gasoline fuel and the LPG fuel are recirculated to the LPG bombe together, decreasing the internal pressure of the LPG bombe using the mixing of the gasoline fuel.

Therefore, according to an exemplary embodiment of the present disclosure, it is possible to cool the inside of the LPG bombe and decrease the vapor pressure of the LPG fuel, and eventually, improve the rechargeability of LPG, charging the LPG fuel even under the condition that the outside temperature rapidly increases due to the hot season.

Furthermore, according to an exemplary embodiment of the present disclosure, it is possible to allow the gasoline fuel to flow into the LPG bombe together with the LPG fuel by using the charging pressure of the LPG charging gun in the state where the gasoline is accommodated in the gasoline mixing chamber to limit the driving of the LPI pump configured for moving the LPG fuel to the gasoline mixing chamber, suppressing the use of the unnecessary energy.

It is understood that the term "automotive" or "vehicular" or other similar term as used herein is inclusive of motor automotives in general such as passenger vehicles including sports utility automotives (operation SUV), buses, trucks, various commercial automotives, watercraft including a variety of boats and ships, aircraft, and the like, and includes hybrid automotives, electric automotives, plug-in hybrid electric automotives, hydrogen-powered automotives and other alternative fuel automotives (e.g., fuels determined from resources other than petroleum). As referred to herein, a hybrid automotive is an automotive that has two or more sources of power, for example both gasoline-powered and electric-powered automotives.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

The above and other features of the present disclosure are discussed infra.

Figure 1:
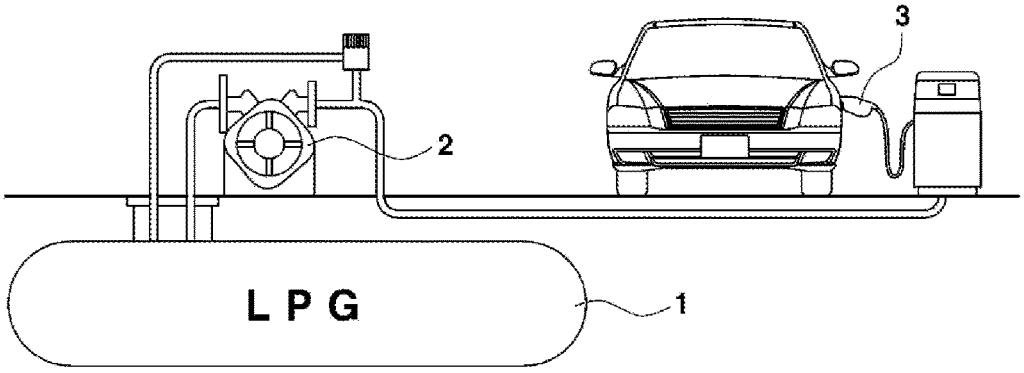
FIG. 1 is a schematic view showing a charging process of an LPG vehicle.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Hereinafter, exemplary embodiments of the present disclosure will be described in detail with reference to the accompanying drawings.

Advantages and features of the present disclosure and a method for achieving the same will become apparent with reference to the exemplary embodiments to be described later in detail However, the present disclosure is not limited to the exemplary embodiments disclosed below but will be implemented in various different forms, and only these exemplary embodiments allow the present disclosure of the present disclosure to be complete, and is provided to fully inform those skilled in the art to which an exemplary embodiment of the present disclosure pertains of the scope of the present disclosure, and the present disclosure is only defined by the scope of the claims.

Furthermore, in the description of the present disclosure, when it is determined that related known technologies may obscure the gist of the present disclosure, a detailed description thereof will be omitted.

Figure 2:
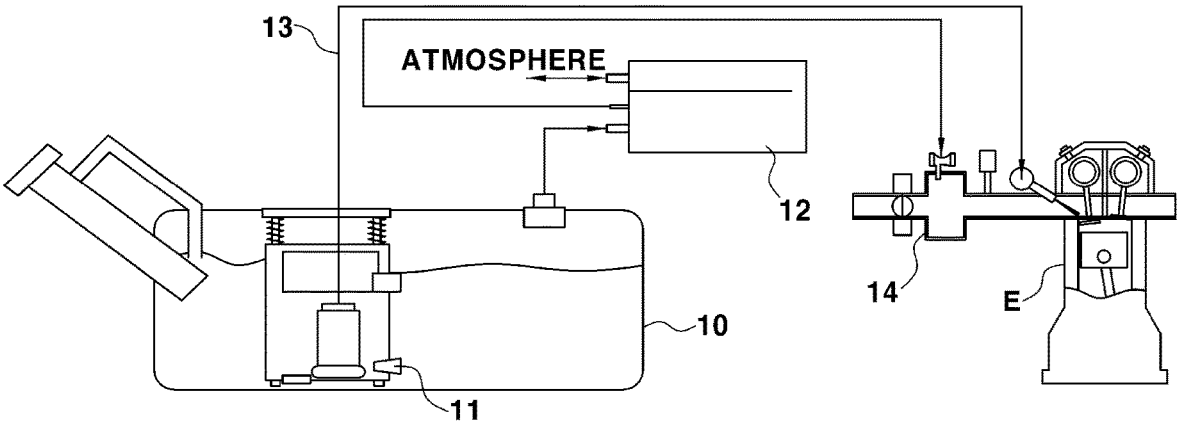
FIG. 2 is a view for showing a gasoline system for an apparatus of charging LPG fuel of a bi-fuel vehicle according to various exemplary embodiments of the present disclosure.
Figure 3:
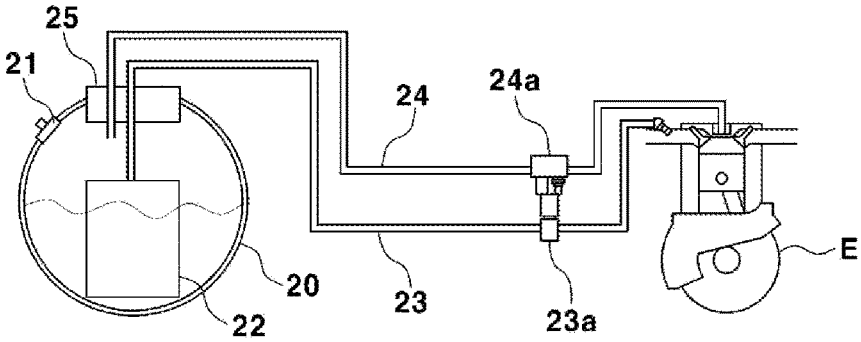
FIG. 3 is a view for showing an LPG system for the apparatus of charging the LPG fuel of the bi-fuel vehicle according to the exemplary embodiment of the present disclosure.
Figure 4:
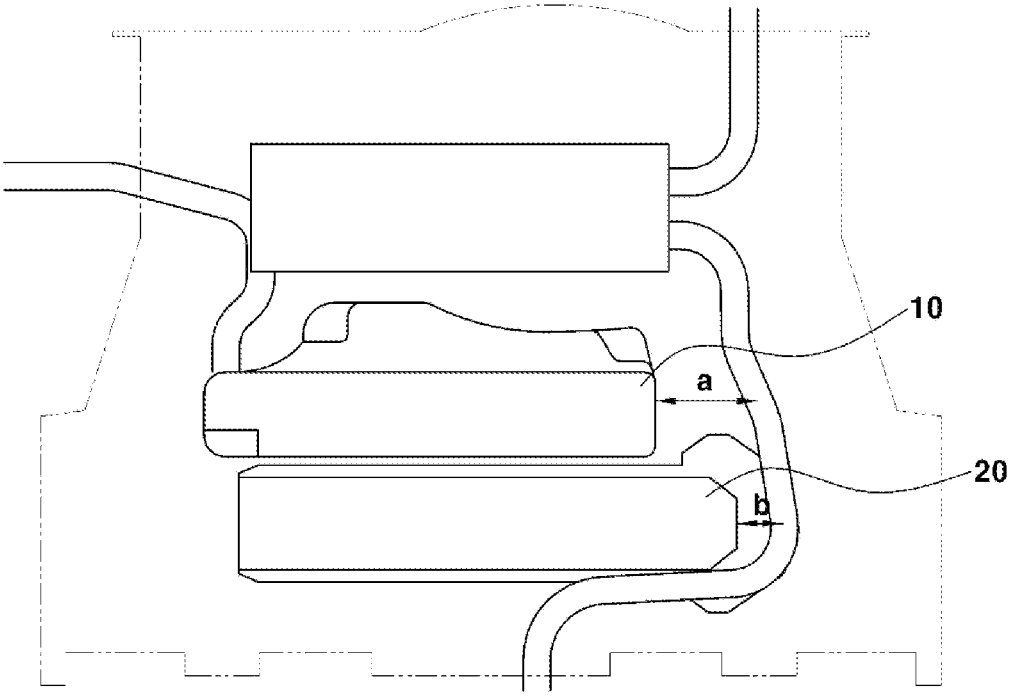
FIG. 4 is a schematic view showing a layout of a structure of an LPG-gasoline bi-fuel system of a general LPG vehicle.

FIG. 2 is a view for showing a gasoline system for an apparatus of charging LPG fuel of a bi-fuel vehicle according to various exemplary embodiments of the present disclosure, FIG. 3 is a view for showing an LPG system for the apparatus of charging the LPG fuel of the bi-fuel vehicle according to the exemplary embodiment of the present disclosure, and FIG. 4 is a schematic view showing a layout of a structure of an LPG-gasoline bi-fuel system of a general LPG vehicle.

Figure 5:
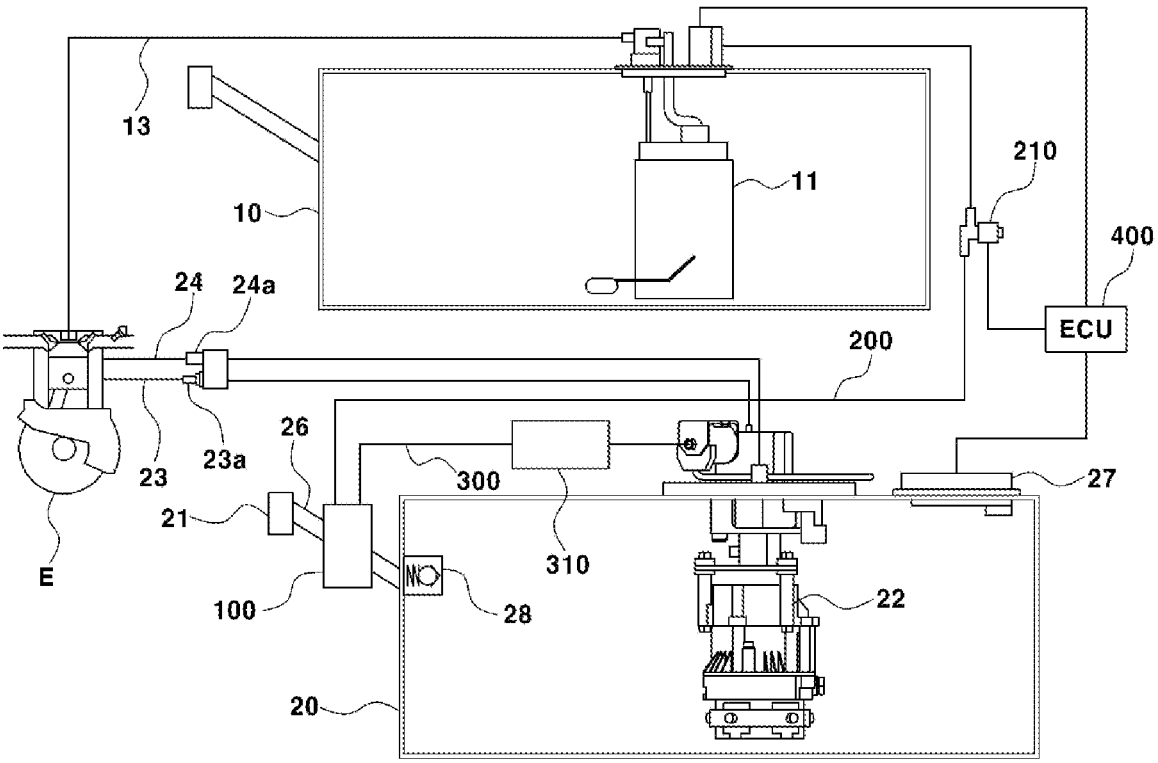
FIG. 5 is a view for showing various exemplary embodiments of the apparatus of charging the LPG fuel of the bi-fuel vehicle according to the exemplary embodiment of the present disclosure.
Figure 6:
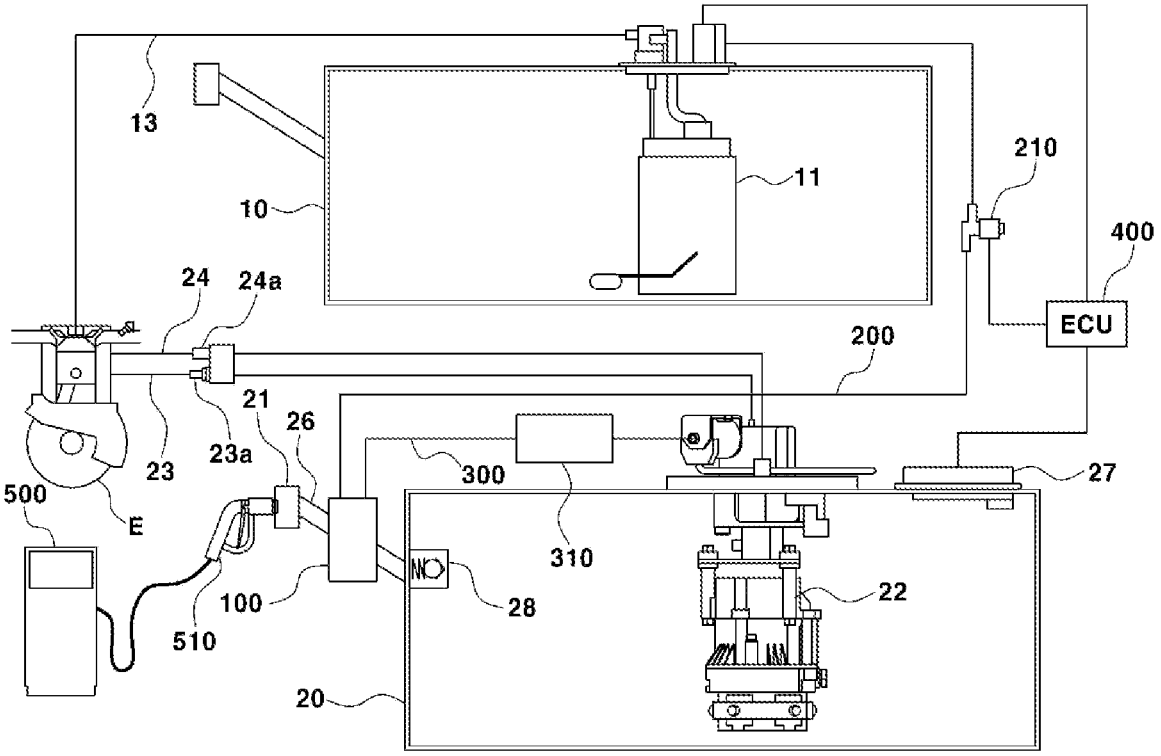
FIG. 6 is a view for showing various exemplary embodiments of the apparatus of charging the LPG fuel of the bi-fuel vehicle according to the exemplary embodiment of the present disclosure.
Figure 7:
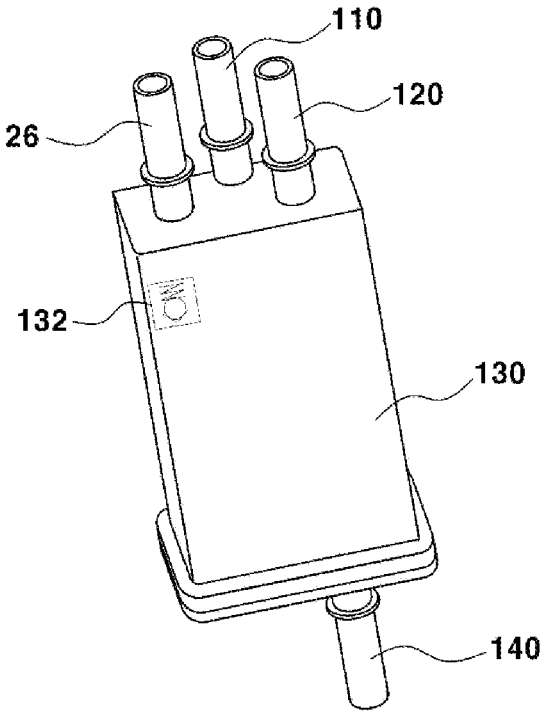
FIG. 7 is a view for showing a gasoline mixing tank for the apparatus of charging the LPG fuel of the bi-fuel vehicle according to the exemplary embodiment of the present disclosure.

Furthermore, FIG. 5 is a view for showing various exemplary embodiments of the apparatus of charging the LPG fuel of the bi-fuel vehicle according to the exemplary embodiment of the present disclosure, FIG. 6 is a view for showing various exemplary embodiments of the apparatus of charging the LPG fuel of the bi-fuel vehicle according to the exemplary embodiment of the present disclosure, and FIG. 7 is a view for showing a gasoline mixing tank for the apparatus of charging the LPG fuel of the bi-fuel vehicle according to the exemplary embodiment of the present disclosure.

As shown in FIG. 2, a gasoline fuel supply system is generally configured to pressure-feed the fuel in a fuel tank 10 to a fuel pump 11 to spray it directly into a cylinder of an engine E from a spray valve.

Furthermore, because gasoline has a very strong volatility, it evaporates from the fuel tank 10 during traveling as well as when the engine E is stopped, a canister 12 configured to collect an evaporation gas is also provided to prevent the consumption of the unnecessary fuel and the air pollution due to the unburned evaporation gas.

To the present end, the canister 12 is connected to the fuel tank 10 and an intake manifold 14 of the engine E separately from a fuel pressure-feeding line 13 by the fuel pump 10, and although not shown in the drawing, a purge control solenoid valve configured to supply the collected evaporation gas to the engine E is provided between the canister 6 and the intake manifold 2.

This canister 12 is filled with particles of charcoal therein, and therefore, the evaporation gas of the fuel generated after the engine E is stopped flows into the canister 12 and is adsorbed to the particles of charcoal, and as the purge control solenoid valve is open during the operation of the engine E, the evaporation gas may be purged by being separated from the charcoal by an engine negative pressure, flowing into the engine E, and being burned.

Meanwhile, as shown in FIG. 3, the LPG fuel supply system includes an LPG bombe 20, and the present LPG bombe 20 is a tank in which LPG fuel is charged, and the LPG bombe 20 is provided with a charging port 21 configured to charge the LPG fuel.

Therefore, when the LPG fuel is injected through a vehicle fuel injection port with the charging gun, the LPG fuel injected by the charging gun is supplied to and charged in the LPG bombe 20 through a charging line.

A fuel pump 22 configured to pump and supply the LPG fuel to the engine E is mounted in the LPG bombe 20, and a fuel supply line 23 is connected between a discharge portion of the present fuel pump 22 and the engine E.

As described above, when the fuel pump 22 is driven, the fuel stored in the LPG bombe 20 is pumped and supplied to the engine E through the fuel supply line 23 when a solenoid valve 23*a* is open.

Furthermore, the LPG fuel supply system supplies a larger amount of LPG fuel than the amount actually required for combustion to the engine E, and therefore, the LPG fuel supply system includes a fuel return device configured to adjust the remaining fuel not sprayed from the engine E at a predetermined pressure through a pressure adjustment machine 24*a* and to return it to the LPG bombe 20.

The fuel return device includes a fuel return line 24 configured to return the liquid LPG fuel from the engine E to the LPG bombe 20, and the present fuel return line 24 is connected between the engine E and the LPG bombe 10.

The fuel return line 24 is connected to the inside of the LPG bombe 20 through a pump plate 25 provided in an opening of the LPG bombe 20.

The pump plate 25 is provided to cover the opening of the LPG bombe 20, and is a plate that seals the inside of the LPG bombe 20 and is integrally coupled with the fuel pump 22 in the LPG bombe 20.

Furthermore, the high-temperature liquid LPG fuel returned from the engine E to the LPG bombe 20 flows through the fuel return line 24 of the fuel return device, and when the high-temperature fuel is returned into the bombe, the internal temperature of the LPG bombe 20 increases, and the pressure in the bombe also increases due to the increase in temperature.

When the internal pressure of the LPG bombe 20 is equal to or greater than the LPG charging pressure of the charging gun, it is not possible to charge the fuel, and there is a problem in that because the internal pressure of the LPG bombe 20 is higher than the LPG charging pressure under the condition that the outside temperature rapidly increases due to the hot season, it is not possible to charge the LPG fuel more.

In other words, since the LPG fuel supply system is a system which is circulated and the fuel returned from the engine E is in a high temperature state, the internal temperature of the LPG bombe 20 has no choice but to increase, while since the gasoline fuel supply system is a system which is not circulated, the internal temperature of the fuel tank 10 increases relatively less than the internal temperature of the LPG bombe 20.

Furthermore, as shown in FIG. 4, since the bi-fuel vehicle generally has a distance (a) between the LPG bombe 20 and a muffler smaller than a distance (b) between the fuel tank 10 and the muffler on the layout and therefore, the LPG bombe 20 is disposed to be closer to the muffler than the fuel tank 10, the LPG bombe 20 is greatly influenced by a heat source, while the fuel tank 10 is relatively less influenced by the heat source.

Therefore, it is possible to cool the inside of the LPG bombe 20 by use of the gasoline fuel in a relatively low temperature state and to decrease the vapor pressure of the LPG fuel to decrease the pressure by cooling the inside of the LPG bombe 20 under the condition that the outside temperature rapidly increases due to the hot season so that the internal pressure of the LPG bombe 20 may be lower than the charging pressure of the LPG charging station, charging the LPG fuel.

To the present end, as shown in FIG. 5, the apparatus of charging the LPG fuel of the bi-fuel vehicle according to the exemplary embodiment of the present disclosure has the gasoline mixing chamber 100 mounted between the gasoline fuel supply system and the LPG fuel supply system conventionally separately provided, respectively, and connects them to each other through a gasoline fuel supply line 200 to be described later, improving the rechargeability of the LPG fuel.

This gasoline mixing chamber 100 is mounted on the LPG bombe 20.

The gasoline mixing chamber 100 is mounted on a quick coupling 26 separately provided on the LPG bombe 20, and the present quick coupling 26 may be classified as a relatively low pressure by a check valve 28 provided on the LPG bombe 20.

This is so that in moving the gasoline fuel in the fuel tank 10 to the gasoline mixing chamber 100, the internal pressure of the LPG bombe 20 is not delivered to the quick coupling 26 due to the check valve 28 provided on the LPG bombe 20, and therefore, the quick coupling 26 becomes a relatively low pressure, and the gasoline fuel in the fuel tank 10 may be delivered to the quick coupling 26 side, the gasoline mixing chamber 100 by its pressure difference.

In other words, because the pressure of the gasoline fuel system is usually 5 bar and the internal pressure of the LPG bombe 20 is usually 10 bar or more, it is not possible to deliver the gasoline fuel of the fuel tank 10 directly into the relatively high pressure LPG bombe 20.

However, because the internal pressure of the LPG bombe 20 is not delivered to the quick coupling 26 by the check valve 28, the gasoline mixing chamber 100 is provided on the quick coupling 26 corresponding to the relatively low pressure so that the gasoline fuel having a relatively higher pressure than the internal pressure of the gasoline mixing chamber 100 may be supplied to the gasoline mixing chamber 100.

As shown in FIG. 7, the gasoline mixing chamber 100 includes a gasoline supply portion 110, an LPG supply portion 120, a body portion 130, and a discharge portion 140.

Here, the gasoline supply portion 110 is connected to the gasoline fuel supply line 200, and the LPG supply portion 120 is connected to the LPG fuel supply line 300.

Furthermore, the body portion 130 accommodates the gasoline fuel and LPG fuel introduced through the gasoline supply portion 110 and the LPG supply portion 120 together, and is provided with a check valve 132 to prevent the gasoline fuel and LPG fuel accommodated therein from being discharged toward the quick coupling 26.

Furthermore, the discharge portion 140 is coupled to the LPG fuel supply line 300 and connected to the LPG bombe 20, and as the LPG fuel is supplied to the body portion 130 in a state where the gasoline fuel is accommodated, the internal pressure thereof increases so that the gasoline fuel and the LPG fuel may move to the LPG bombe 20 together.

The gasoline fuel supply line 200 connects the LPG bombe 20 with the gasoline mixing chamber 100, and forms a passage through which the gasoline fuel moves to the gasoline mixing chamber 100 as a first valve 210 is open.

The first valve 210 may be formed of the solenoid valve, and selectively open as the internal pressure of the LPG bombe 20 is detected as a predetermined reference pressure under the condition that the LPG charging is impossible (minimum pressure of the LPG charging stations in Europe), for example, 11 bar or more.

Furthermore, the LPG fuel supply line 300 connects the LPG bombe 20 with the gasoline mixing chamber 100, and forms a passage through which the LPG fuel moves to the gasoline mixing chamber 100 as a second valve 310 is open.

Furthermore, a control unit 400 opens the first valve 210 as the internal pressure of the LPG bombe 20 reaches the predetermined reference pressure, and thereafter, controls the LPG fuel to be recirculated to the LPG bombe 20 together with the gasoline fuel by the pressure of the LPG fuel moving to the gasoline mixing chamber 100 at a predetermined pressure in a state where the first valve 210 is blocked.

In other words, the control unit 400 blocks the first valve 210 when a preset supply time, for example, 10 seconds or more elapses depending upon the capacity of the gasoline mixing chamber 100, opens the second valve 310 in a state where the gasoline is filled in the gasoline mixing chamber 100, and controls the operation of a line per inch (LPI) pump 22 provided on the LPG bombe 20 to supply the LPG fuel.

Therefore, an LPI drive 27 is operated by a control signal of the control unit 400, and when the revolutions per minute (rpm) of the LPI pump 22 is increased by the operation of the LPI drive 27, the discharge flow rate of the LPG fuel for moving to the LPG fuel supply line 300 through the LPI pump 22 may be increased to become the flow rate that opens the second valve 310.

As a result, the LPG fuel having the internal pressure of the LPG bombe 20 moves to the gasoline mixing chamber 100 by opening the second valve 310, and the pressure of the LPG fuel is added to the pressure of the accommodated gasoline fuel and therefore, the gasoline fuel and LPG fuel in the gasoline mixing chamber 100 move to the LPG bombe 20 together.

Therefore, through the aforementioned control of the control unit 400, the gasoline fuel and the LPG fuel may be recirculated to the LPG bombe 20 together, decreasing the internal pressure of the LPG bombe using the gasoline mixing, and it is possible to cool the inside of the LPG bombe 20 and at the same time, to decrease the vapor pressure of the LPG fuel, thereby improving the rechargeability of the LPG.

Furthermore, as shown in FIG. 6, the control unit 400 may use the charging pressure of a charging gun 510 provided on an LPG charger 500 in a state where the first valve 210 is blocked, and allow the gasoline fuel to be mixed into the LPG bombe 20.

In other words, the control unit 400 determines that the gasoline fuel for mixing is accommodated in the gasoline mixing chamber 100 when the preset supply time, for example, 10 seconds or more elapses depending upon the capacity of the gasoline mixing chamber 100 to block the first valve 210.

If the LPG charging is performed through the charging gun 510 of the LPG charger 500 in a state of maintaining the blocking state of the second valve 310, the control unit 400 allows the LPG fuel to flow into the LPG bombe 20 together with the gasoline fuel accommodated in the gasoline mixing chamber 100 by use of the charging pressure of the LPG gun 510.

This allows the LPG fuel injected by use of the charging pressure of the charging gun 510 to flow into the LPG bombe 20 together with the gasoline fuel accommodated in the gasoline mixing chamber 100, limiting the driving of the LPI pump 220 for moving the LPG fuel to the gasoline mixing chamber 100, and suppressing the use of the unnecessary energy due to the increase in the RPM of the LPI pump 220.

Figure 8:
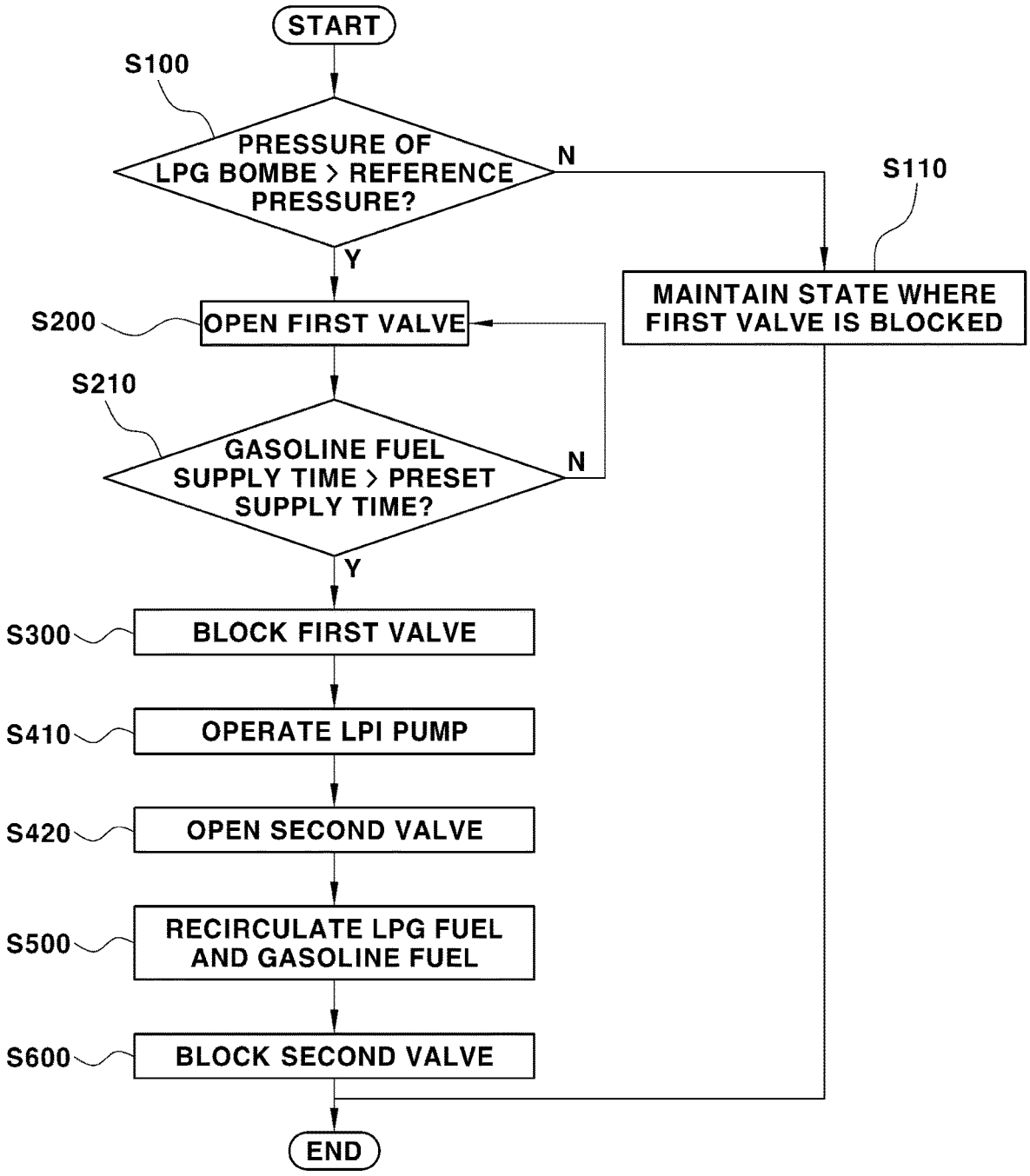
FIG. 8 is a view for sequentially showing various exemplary embodiments of a method for charging LPG fuel of a bi-fuel vehicle according to various exemplary embodiments of the present disclosure.
Figure 9:
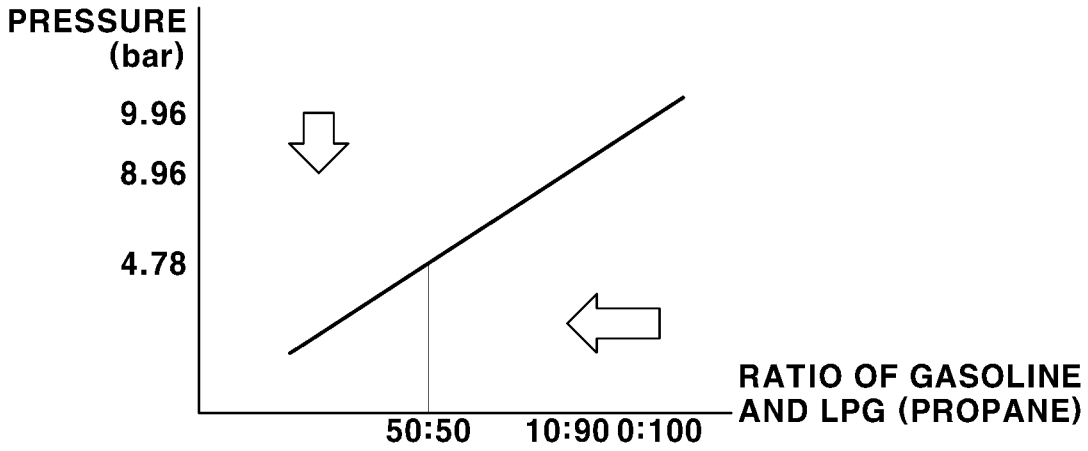
FIG. 9 is a view showing a change in an internal pressure of an LPG bombe compared to a ratio of gasoline fuel and LPG fuel in the method for charging the LPG fuel of the bi-fuel vehicle according to various exemplary embodiments of the present disclosure.
Figure 10:
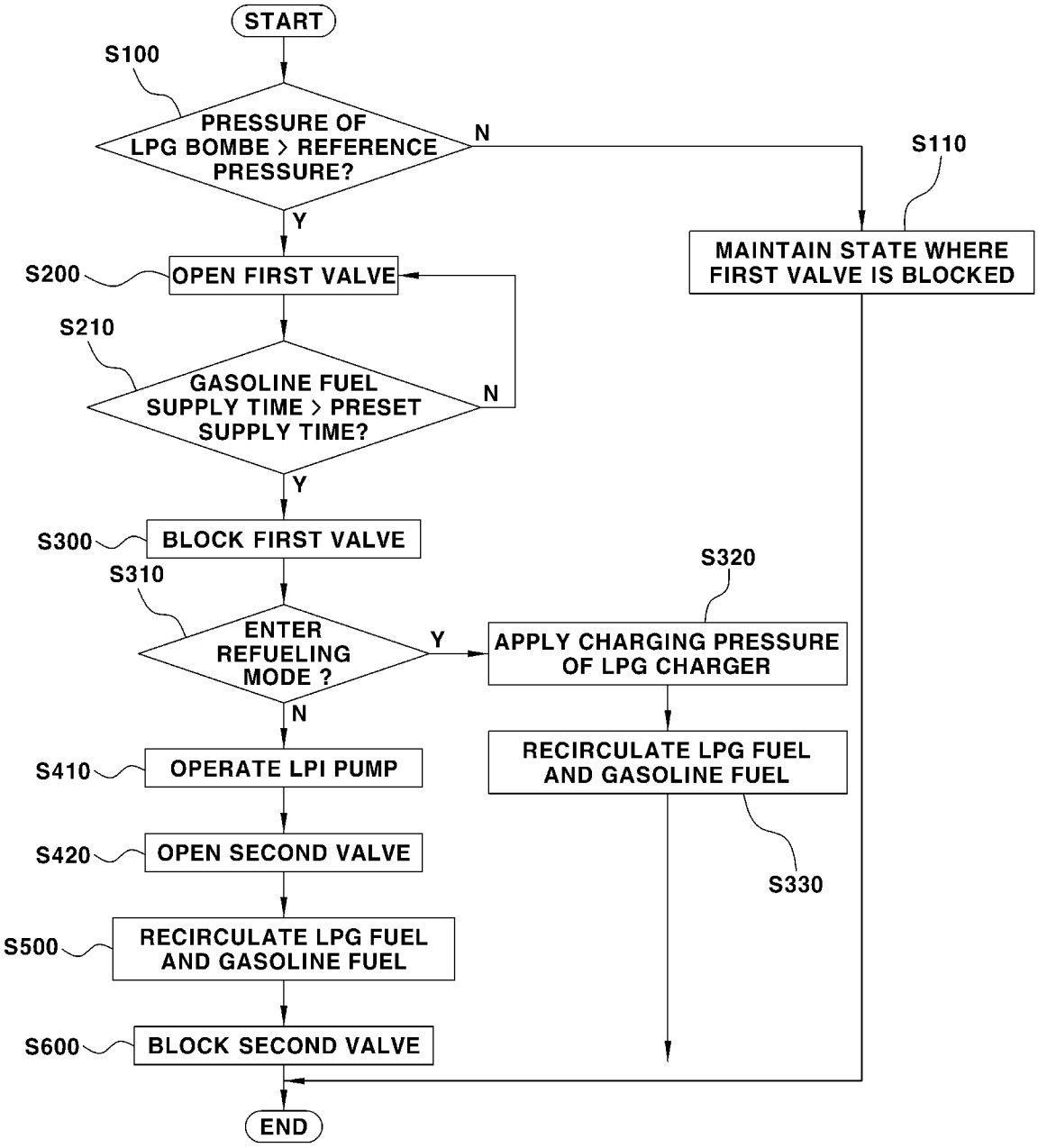
FIG. 10 is a view for sequentially showing various exemplary embodiments of the method for charging the LPG fuel of the bi-fuel vehicle according to various exemplary embodiments of the present disclosure.

Hereinafter, FIG. 8 is a view for sequentially showing various exemplary embodiments of a method for charging LPG fuel of a bi-fuel vehicle according to various exemplary embodiments of the present disclosure, FIG. 9 is a view showing a change in an internal pressure of an LPG bombe compared to a ratio of gasoline fuel and LPG fuel in the method for charging the LPG fuel of the bi-fuel vehicle according to various exemplary embodiments of the present disclosure, and FIG. 10 is a view for sequentially showing various exemplary embodiments of the method for charging the LPG fuel of the bi-fuel vehicle according to various exemplary embodiments of the present disclosure.

As shown in FIG. 8, the method for charging the LPG fuel of the bi-fuel vehicle according to the exemplary embodiment of the present disclosure will be sequentially referred to as follows based on the aforementioned apparatus of charging the LPG fuel of the bi-fuel vehicle described above with reference to FIG. 2, FIG. 3, FIG. 4, FIG. 5, FIG. 6, and FIG. 7.

The internal pressure of the LPG bombe 20 is measured by a separate pressure detector, and the internal pressure of the LPG bombe 20 is compared with the predetermined reference pressure by the control unit 400 (S100).

If the internal pressure of the LPG bombe 20 is the reference pressure, for example, 11 bar or less (S100), the LPG charging may be performed, and therefore, the blocking state of the first valve 210 is maintained (S110) and the gasoline fuel in the fuel tank 10 is prevented from moving to the gasoline mixing chamber 100 by the control unit 400.

If the internal pressure of the LPG bombe 20 is the reference pressure, for example, 11 bar or more (S100), it corresponds to the condition that the LPG charging may not be performed (minimum pressure of the LPG charging station in Europe), and therefore, the first valve 210 is opened to allow the gasoline fuel to move to the gasoline mixing chamber 100 by the control unit 400 (S200).

As described above, as the first valve 210 is open, the gasoline fuel in the fuel tank 10 moves along the gasoline fuel supply line 200 and is accommodated in the gasoline mixing chamber 100.

At the present time, the control unit 400 blocks the first valve 210 (S300) when the time at which the gasoline fuel is supplied elapses the preset supply time, for example, 10 seconds or more depending upon the capacity of the gasoline mixing chamber 100 (S210).

Here, the supply time may be set depending upon the capacity of the gasoline fuel to be supplied to the gasoline mixing chamber 100, but is not determined.

If the supply time is set as described above, the capacity of the gasoline fuel supplied to the gasoline mixing chamber 100 is increased when the supply time is long, and as a result, the capacity of the gasoline fuel to be mixed into the LPG bombe 20 together with the LPG fuel is increased later, and the capacity of the gasoline fuel for mixing may also be adjusted by adjusting the present supply time.

In other words, as shown in FIG. 9, because it may be confirmed that the internal pressure of the LPG bombe 20 decreases as the gasoline ratio in the LPG bombe 20 increases, it is also possible to set the capacity of the gasoline fuel accommodated in the gasoline mixing chamber 100 to be mixed into the LPG bombe 10 by setting the supply time.

Meanwhile, as the first valve 210 is blocked (S300), the gasoline mixing chamber 100 is in a state where the gasoline fuel is accommodated, and at the instant time, the second valve 310 is open and the LPG fuel of the LPG bombe 20 having the relatively high pressure is circulated to the gasoline mixing chamber 100 by the pressure difference by the control unit 400, and the pressure of the LPG fuel circulated and the pressure of the gasoline fuel accommodated in the gasoline mixing chamber 100 are added so that the check valve 28 is open by these pressures (see FIG. 5), allowing the LPG fuel to be recirculated to the LPG bombe 20 together with the gasoline fuel (S500).

The pressure of the LPG fuel corresponds to the internal pressure of the LPG bombe 20, that is, 11 bar, and the pressure of the gasoline fuel corresponds to 5 bar which is the pressure of the gasoline fuel supply system, and as a result, the internal pressure of the gasoline mixing chamber 100 becomes about 16 bar, and therefore, is in a state of being higher than the internal pressure of the LPG bombe 10, opening the check valve 28 so that the LPG fuel is recirculated to the LPG bombe 20 together with the gasoline fuel.

To the present end, first, the first valve 210 is blocked, a signal for increasing the RPM of the line per inch (LPI) pump 22 is delivered to the LPG drive 27, and the LPI pump 22 is operated by the control unit 400 (S410).

As described above, as the LPI pump 22 operates, the flow rate of the LPG fuel discharged along the LPG fuel supply line 300 increases and the second valve 310 is open, allowing the LPG fuel accommodated in the LPG bombe 20 to have the pressure and to be supplied to the gasoline mixing chamber 100 (S420).

As a result, the pressure of the supplied LPG fuel and the pressure of the gasoline fuel are added so that the LPG fuel is recirculated to the LPG bombe 20 together with the gasoline fuel in the gasoline mixing chamber 100 (S500), and after a predetermined time period at which all of the gasoline fuel accommodated in the gasoline mixing chamber 100 is recirculated together with the LPG fuel has elapsed, the operation of the LPI pump 22 is interrupted as the charging pressure of the LPG fuel is greater than the pressure of the LPG bombe 20 (S600).

This is to interrupt the operation of the LPI pump 22 to minimize the user of the energy because when the charging pressure of the LPG fuel is greater than the pressure of the LPG bombe 20 as the gasoline fuel is supplied to the LPG bombe 20 to perform the internal cooling and decrease the vapor pressure of the LPG fuel, it becomes the condition that the LPG charging may be performed depending upon the pressure difference.

Meanwhile, as shown in FIG. 10, in blocking the first valve 210 (S300), the LPG fuel and the gasoline fuel may be mixed in different methods depending upon whether to enter a refueling mode in a state where the gasoline fuel is accommodated in the gasoline mixing chamber 100.

In other words, as a result of determining whether to enter the refueling mode by the control unit 400 (S310), when not entering the refueling mode, the LPG fuel accommodated in the LPG bombe 20 is supplied to the gasoline mixing chamber 100 as the LPI pump 22 is operated as in the exemplary embodiment described above with reference to FIG. 8 (S410).

On the other hand, as a result of determining whether to enter the refueling mode by the control unit 400 (S310), when entering the refueling mode, the state where the second valve 310 is blocked is maintained, the LPG fuel is injected by use of the charging pressure of the charging gun 510 (S320), and the LPG fuel is supplied to the LPG bombe 20 together with the gasoline fuel accommodated in the gasoline mixing chamber 100 (S330).

Here, the refueling mode means a state where the LPG fuel is injected into the LPG bombe 20, and it is determined that the internal pressure of the LPG bombe 20 measured by the pressure detector is equal to or greater than the reference pressure in the comparing (S100), but since the LPG fuel may be actually charged due to an error of the control unit 400, an error of the pressure detector, etc., whether to enter the refueling mode is determined through the actual refueling.

As the determination result through the control unit 400, if it is determined that a vehicle speed is 0 and a fuel gauge increases by a predetermined range or more, it is in a state where the actual refueling is performed, that is, the gasoline fuel accommodated in the gasoline mixing chamber 100 is supplied into the LPG bombe 20 through the charging pressure of the charging gun 510 and therefore, the LPG fuel may be charged, preventing the LPI pump 22 for mixing the gasoline fuel into the LPG bombe 20 from being operated even if it is determined that the internal pressure of the LPG bombe 20 is initially the reference pressure or more.

Therefore, according to the exemplary embodiment of the present disclosure, if it is determined that the actual refueling is performed by determining whether to enter the refueling mode, it is in the state where the LPG fuel injected by use of the charging pressure of the charging gun 510 flows into the LPG bombe 20 together with the gasoline fuel, limiting the driving of the separate LPI pump 220 for mixing the gasoline fuel, and suppressing the use of the unnecessary energy due to the increase in the RPM of the LPI pump 220.

According to an exemplary embodiment of the present disclosure, it is possible to install the gasoline mixing chamber in the quick coupling of the LPG bombe, allow the gasoline fuel to move to the gasoline mixing chamber as the pressure of the LPG bombe reaches the reference pressure of the charging station, and also allow the LPG fuel to move to the gasoline mixing chamber so that the gasoline fuel and the LPG fuel are recirculated to the LPG bombe, decreasing the internal pressure of the LPG bombe using the mixing of the gasoline fuel.

Therefore, according to an exemplary embodiment of the present disclosure, it is possible to cool the inside of the LPG bombe and decrease the vapor pressure of the LPG fuel, and eventually improve the rechargeability of LPG, charging the LPG fuel even under the condition that the outside temperature rapidly increases due to the hot season.

Furthermore, according to an exemplary embodiment of the present disclosure, it is possible to allow the gasoline fuel to flow into the LPG bombe together with the LPG fuel by use of the charging pressure of the LPG charging gun in the state where the gasoline is accommodated in the gasoline mixing chamber to limit the driving of the LPI pump configured for moving the LPG fuel to the gasoline mixing chamber, suppressing the use of the unnecessary energy.

Furthermore, the term related to a control device such as "controller", "control apparatus", "control unit", "control device", "control module", or "server", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present disclosure. The control device according to exemplary embodiments of the present disclosure may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method included in the aforementioned various exemplary embodiments of the present disclosure.

The aforementioned invention can also be embodied as computer readable codes on a computer readable recording medium. The computer readable recording medium is any data storage device that can store data which may be thereafter read by a computer system and store and execute program instructions which may be thereafter read by a computer system. Examples of the computer readable recording medium include Hard Disk Drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet). Examples of the program instruction include machine language code such as those generated by a compiler, as well as high-level language code which may be executed by a computer using an interpreter or the like.

In various exemplary embodiments of the present disclosure, each operation described above may be performed by a control device, and the control device may be configured by a plurality of control devices, or an integrated single control device.

In various exemplary embodiments of the present disclosure, the control device may be implemented in a form of hardware or software, or may be implemented in a combination of hardware and software.

Furthermore, the terms such as "unit", "module", etc. Included in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. An apparatus of charging Liquefied Petroleum Gas (LPG) fuel of a bi-fuel vehicle, the apparatus including:

a gasoline mixing chamber mounted on an LPG bombe side;

a first valve and a second valve;

a gasoline fuel supply line connecting the gasoline mixing chamber with a fuel tank and allowing gasoline fuel to move to the gasoline mixing chamber as the first valve is open;

an LPG fuel supply line connecting an LPG bombe with the gasoline mixing chamber and allowing LPG fuel to move to the gasoline mixing chamber as the second valve is open; and a control unit configured to open the first valve and control the LPG fuel to be recirculated to the LPG bombe together with the gasoline fuel by a pressure of the LPG fuel moving to the gasoline mixing chamber, as an internal pressure of the LPG bombe reaches a predetermined reference pressure.

2. The apparatus of claim 1, wherein when a preset supply time elapses depending upon a capacity of the gasoline mixing chamber, the control unit is configured to block the first valve and to operate a line per inch (LPI) pump provided on the LPG bombe to supply the LPG fuel to open the second valve.

3. The apparatus of claim 1, wherein when a preset supply time elapses depending upon a capacity of the gasoline mixing chamber, the control unit is configured to block the first valve, to maintain a state where the second valve is blocked, and to allow the LPG fuel to flow into the LPG bombe together with the gasoline fuel accommodated in the gasoline mixing chamber by use of a charging pressure of an LPG charger.

4. The apparatus of claim 1, wherein the gasoline mixing chamber is mounted on a quick coupling classified into a relatively low pressure in the LPG bombe by a check valve provided on the LPG bombe side thereof.

5. The apparatus of claim 1, wherein the gasoline mixing chamber includes:

a gasoline supply portion connected to the gasoline fuel supply line;

an LPG supply portion connected to the LPG fuel supply line;

a body portion including the gasoline fuel and the LPG fuel introduced through the gasoline supply portion and the LPG supply portion, respectively accommodated therein; and a discharging portion connected to the LPG bombe so that the gasoline fuel and the LPG fuel move to the LPG bombe together due to an increase in the internal pressure as the LPG fuel is supplied to the body portion.

6. A method of controlling the apparatus of charging Liquefied Petroleum Gas (LPG) fuel of the claim 1, the method comprising:

comparing, by the control unit, an internal pressure of the LPG bombe with the predetermined reference pressure;

supplying the gasoline fuel that opens the first valve to allow the gasoline fuel to flow along the gasoline fuel supply line and to move to the gasoline mixing chamber by the control unit when the internal pressure of the LPG bombe exceeds the predetermined reference pressure in a result of the comparing;

supplying the LPG fuel that allows the LPG fuel to move to the gasoline mixing chamber in a state where the gasoline fuel is accommodated in the gasoline mixing chamber; and recirculating the LPG fuel that allows the LPG fuel to be supplied to the LPG bombe together with the gasoline fuel accommodated in the gasoline mixing chamber by a pressure of the LPG fuel moving to the gasoline mixing chamber.

7. The method of claim 6, including:

when a preset supply time elapses depending upon a capacity of the gasoline mixing chamber, in the supplying of the LPG fuel, blocking the first valve and operating a line per inch (LPI) pump provided on the LPG bombe by the control unit to supply the LPG fuel to open the second valve.

8. The method of claim 7, wherein the supplying of the LPG fuel comprises:

operating, by the control unit, the LPI pump by blocking the first valve; and opening the second valve that allows the LPG fuel accommodated in the LPG bombe to have a pressure and to be supplied to the gasoline mixing chamber.

9. The method of claim 8, including:

in the recirculating of the fuel, interrupting, by the control unit, an operation of the LPI pump as a charging pressure of the LPG fuel is greater than the pressure of the LPG bombe.

10. The method of claim 6, including:

in the supplying of the LPG fuel, determining, by the control unit, whether to enter a refueling mode that blocks the first valve and determining, by the control unit, whether to enter a refueling mode in a state where the gasoline fuel is accommodated in the gasoline mixing chamber.

11. The method of claim 10, including:

in the determining of whether to enter the refueling mode, maintaining the state where the second valve is blocked and allowing the LPG fuel to be supplied to the LPG bombe together with the gasoline fuel accommodated in the gasoline mixing chamber by using a charging pressure of an LPG charger when it is determined as entering the refueling mode, and in the determining of whether to enter the refueling mode, blocking the first valve and operating an LPI pump provided on the LPG bombe to open the second valve by the control unit to supply the LPG fuel when a preset supply time elapses depending upon a capacity of the gasoline mixing chamber when it is determined as not entering the refueling mode.

12. A method for charging Liquefied Petroleum Gas (LPG) fuel of a bi-fuel vehicle, the method comprising:

comparing, by a control unit, an internal pressure of an LPG bombe with a predetermined reference pressure;

supplying gasoline fuel that opens a first valve to allow the gasoline fuel to flow along a gasoline fuel supply line and to move to a gasoline mixing chamber by the control unit when the internal pressure of the LPG bombe exceeds the predetermined reference pressure in a result of the comparing;

supplying LPG fuel that allows the LPG fuel to move to the gasoline mixing chamber in a state where the gasoline fuel is accommodated in the gasoline mixing chamber; and recirculating the LPG fuel that allows the LPG fuel to be supplied to the LPG bombe together with the gasoline fuel accommodated in the gasoline mixing chamber by a pressure of the LPG fuel moving to the gasoline mixing chamber.

13. The method of claim 12, including:

when a preset supply time elapses depending upon a capacity of the gasoline mixing chamber, in the supplying of the LPG fuel, blocking the first valve and operating a line per inch (LPI) pump provided on the LPG bombe by the control unit to supply the LPG fuel to open the second valve.

14. The method of claim 13, wherein the supplying of the LPG fuel comprises:

operating, by the control unit, the LPI pump by blocking the first valve; and opening the second valve that allows the LPG fuel accommodated in the LPG bombe to have a pressure and to be supplied to the gasoline mixing chamber.

15. The method of claim 14, including:

in the recirculating of the fuel, interrupting, by the control unit, an operation of the LPI pump as a charging pressure of the LPG fuel is greater than the pressure of the LPG bombe.

16. The method of claim 12, including:

in the supplying of the LPG fuel, determining, by the control unit, whether to enter a refueling mode that blocks the first valve and determining, by the control unit, whether to enter a refueling mode in a state where the gasoline fuel is accommodated in the gasoline mixing chamber.

17. The method of claim 16, including:

in the determining of whether to enter the refueling mode, maintaining the state where the second valve is blocked and allowing the LPG fuel to be supplied to the LPG bombe together with the gasoline fuel accommodated in the gasoline mixing chamber by using a charging pressure of an LPG charger when it is determined as entering the refueling mode.

18. The method of claim 16, including:

in the determining of whether to enter the refueling mode, blocking the first valve and operating an LPI pump provided on the LPG bombe to open the second valve by the control unit to supply the LPG fuel when a preset supply time elapses depending upon a capacity of the gasoline mixing chamber when it is determined as not entering the refueling mode.

19. The method of claim 12, wherein the gasoline mixing chamber is mounted on a quick coupling classified into a relatively low pressure in the LPG bombe by a check valve provided on the LPG bombe.

20. A non-transitory computer readable storage medium on which a program for performing the method of claim 12 is recorded.

* * * * *